United States Patent [19]

Basile

[11] 4,066,156

[45] Jan. 3, 1978

[54] EQUIPMENT CARRIER

[76] Inventor: John Basile, 7701 Densmore Ave., Van Nuys, Calif. 91406

[21] Appl. No.: 701,865

[22] Filed: July 1, 1976

[51] Int. Cl.[2] ..... A45C 5/14

[52] U.S. Cl. ..... 190/18 A; 150/52 A; 190/52; 206/315 B; 220/260; 280/47.26

[58] Field of Search ..... 280/47.26, 47.17; 206/315 B; 190/51, 52, 18 A; 150/52 A; 221/191, 260; 211/14, 15; 312/49

[56] References Cited

U.S. PATENT DOCUMENTS

| | | | |
|---|---|---|---|
| 1,144,559 | 6/1915 | Mendelson | 221/260 X |
| 2,872,029 | 2/1959 | Cart | 206/315 B |
| 3,308,911 | 3/1967 | Stevens et al. | 206/315 B |
| 3,606,372 | 9/1971 | Browning | 280/47.17 |

*Primary Examiner*—Joseph F. Peters, Jr.
*Assistant Examiner*—John A. Pekar

[57] ABSTRACT

Herein described is a bowling ball and bowling ball equipment carrier which includes an upper compartment for holding the equipment and a lower compartment for carrying a pair of bowling balls. A front opening door is provided for access to the lower compartment and a top opening door is provided for access to an upper compartment. A strap is provided in both the lower compartments which is placed under the bowling ball and extends into the upper compartment so that as the selected strap is pulled it moves the selected bowling ball from its resting place in the lower compartment out into a similar resting place on the front door.

11 Claims, 6 Drawing Figures

EQUIPMENT CARRIER

BACKGROUND OF THE INVENTION

This invention relates to equipment carrying cases and more particularly to a novel and improved bowling ball and bowling equipment carrier and the like.

It has become very popular as well as practical for bowlers to own and carry at least two bowling balls. The need to carry two bowling balls arose when recently bowling establishments started using different types of materials on the surface of alleys. As is well known to those skilled in the art, a good bowler bowls with a certain amount of spin on the ball so that it breaks or curves as it is rolled down the alley and generally into the pins. This provides better accuracy in the sport of bowling. The old so-called hard rubber balls generally do not break on the newer surface material which are now, in some cases, coated with a plastic material. Conversely bowling ball manufacturers have begun manufacturing bowling balls of a hard plastic material and these balls will break or curve on the newer materials on the bowling alley surface but are somewhat ineffective on the old surfaces.

Sometimes a bowler carriers two balls because of his desire for two different grips on the ball. A bowler may want to change to a ball with a larger finger hole because his hand swells, for example, after he has bowled for a considerable amount of time. On the otherhand, a carrier may be desirable which is capable of carrying two bowling balls for two different purposes such as a husband and a wife team.

Too, the bowler needs a convenient place to carry other equipment such as shoes, socks, towels, wrist bands and gloves, brushes and the like as aid in this sport.

To carry all this equipment and two bowling balls at the same time the ideal carrying case should have separate compartments for each ball and a separate compartment or compartments for the equipment which must be carried by the bowler. The need for such a bowling ball and equipment carrier has arisen due to the heretofore mentioned reasons, yet such a carrier has not been provided before the present invention.

SUMMARY OF THE INVENTION

Briefly described the present invention comprises a case having a pair of lower compartments each having a platform on the bottom thereof for holding a bowling ball therein. In one embodiment of the invention one compartment is separated from the other one. Each compartment has the indentation in the bottom thereof so that the ball will, in effect, rest comfortably in its own compartment witout rolling around during transportation. A strap is connected to the front portion of the carrier in each compartment and extends upwardly into a second compartment placed above the first compartment and may have a suitable ring thereon for grasping. When the ball is set in its resting place in its lower compartment, it rests directly across the strap. As the strap is pulled to a taunt-like position, the ball is allowed to rise from its resting place and push forward.

A front opening door is provided in the lower compartment, and has a resting place therein. As the strap is pulled taunt, the bowling ball moves forward, urging the door open and moves to the resting position on the front opening door ready for the bowler's use. The other ball can be moved forward from its resting place within the compartment by pulling the strap on its side taunt moving it into its resting place on the front opening door.

Stationed above the lower compartment is an upper compartment which has a top opening door which may be lifted in a suitable manner to expose the bowling shoes, towels, brushes and other various sundry equipment used by the particular bowlers.

The entire compartment may be placed upon a pair of wheels and a telescoping handle is coupled to the case and can be extended in length so that the bowling ball carrier with both bowling balls therein can then be wheeled into and out of the bowling alley without any effort.

On the otherhand, one may also provide a suitable handle on the top of the bowling ball carrier and it may be carried in a normal manner for being carried up and down stairs and/or lifted into and out of an automobile.

DESCRIPTION OF THE DRAWINGS

These and other features and examples may be more clearly understood by referring to the detailed description of the preferred embodiment of this invention wherein like reference numerals indicate like and corresponding parts throughout the several views and wherein.

DESCRIPTION OF THE SHOWN EMBODIMENT

Figures 1, 2:
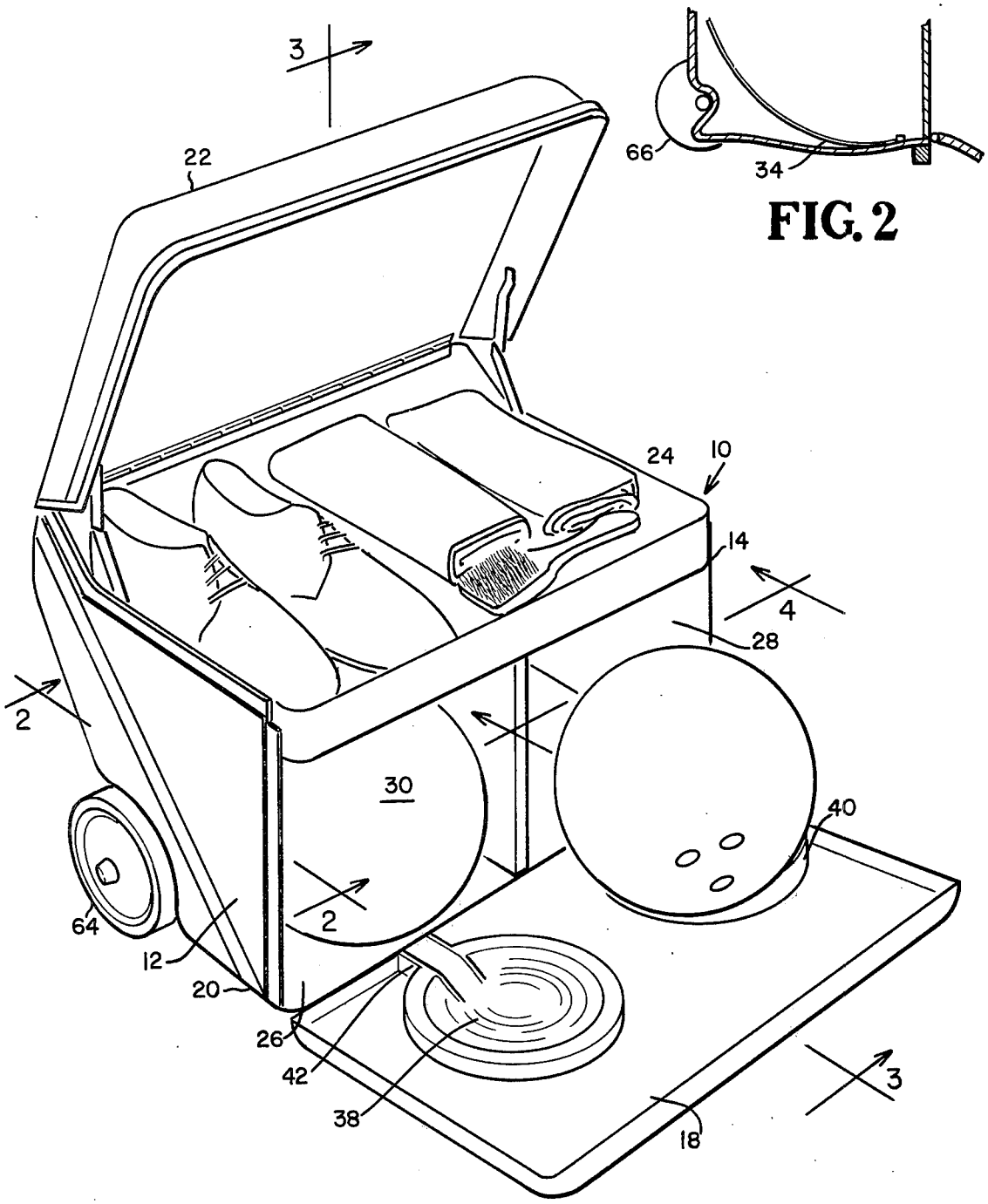
FIG. 1 is a perspective view of the bowling ball carrier of the present invention illustrating both doors open and at least one of the bowling balls being extended from inside the compartment onto its resting place on the frontal door.
FIG. 2 is a partial section taken along the lines 2—2 of FIG. 1 which shows the resting place for the bowling balls and the connection of the straps therein.
Figure 5:
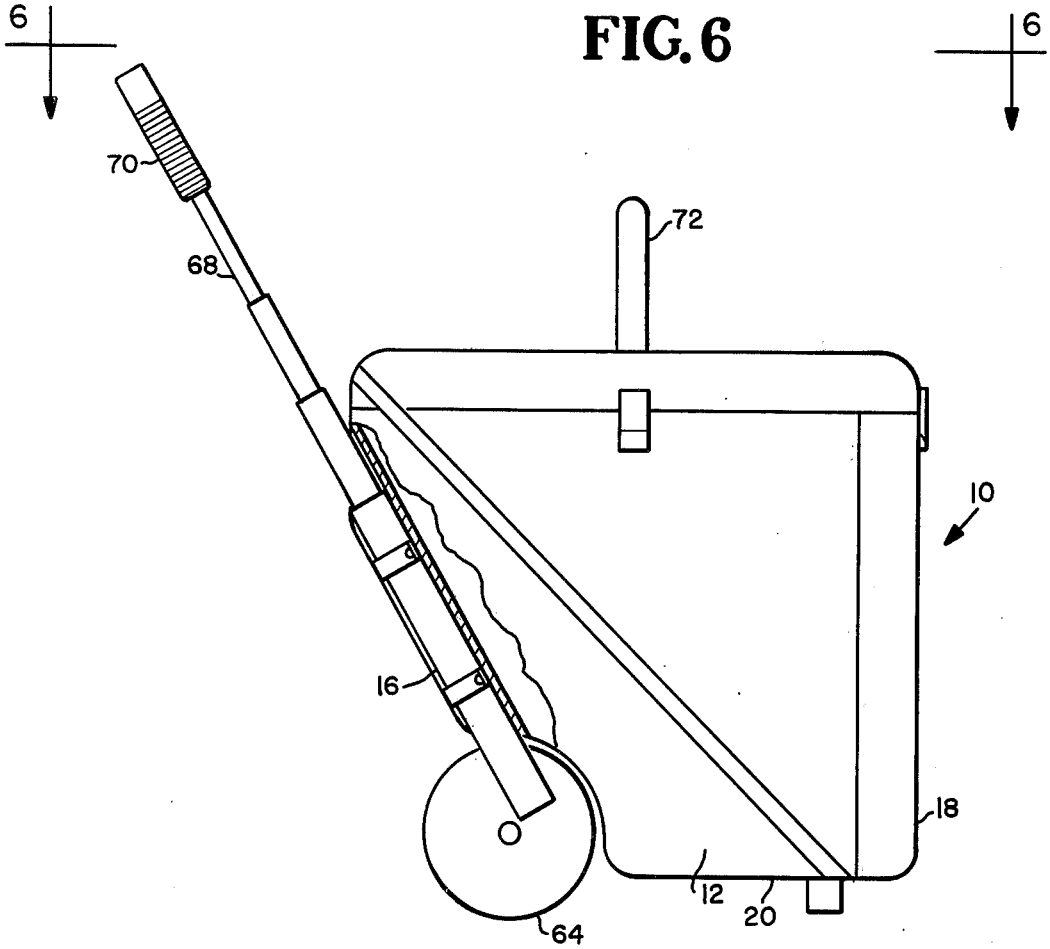
FIG. 5 is a side view of a bowling ball carrier illustrating the telescoping handle and top handle.

Turning now to a more detailed description of the shown embodiment there is shown in FIG. 1 a bowling ball carrier referred to generally by the reference numeral 10 which may be constructed from a plastic-like material. The parts thereof may be by a vacuum forming method or other suitable methods well-known to those skilled in the art. As shown in FIG. 5, the bowling ball carrier 10 is box-like in shape and has a pair of side panels 12 and 14 and a back panel 16. A front opening door 18 is connected to a bottom panel 20 by suitable hinges which may be in the form of so-called piano hinges. A top opening door 22 is connected to the back panel by suitable hinges.

The shown embodiment of the bowling ball carrier 10 is divided into an upper compartment 24 and a pair of lower compartments 26 and 28. The lower compartments are sufficient in size so that each will hold a bowling ball shown as 30 and 32.

As shown in FIG. 2, the bottom panel 20 has a concave indentation 34 in the compartment 26 so that the bowling ball 30 will rest therein. A similar indentation 36 is provided in the compartment 28 for bowling ball 32. This allows the balls 30 and 32 to be carried in the carrier 10 without rolling around in the compartments 26 and 28 or rolling out when the door 18 is opened. The front opening door 18 has a pair of similar resting places in the form of concave indentations 38 and 40 so that the bowling balls as they are moved from their resting places within the compartments 26 and/or 28 in a manner to be set forth hereinafter. They will roll down a groove 42 and rest in the cover readily accessible. While only one groove 42 is shown in the drawings it must be understood that a similar groove is provided for each ball and compartment. As the door is closed the concave portions 40 and 41 on the front opening door 18 bears against the bowling balls and secures the balls from rolling around in their respective compartments.

The top compartment 24 is suitable in size to hold a pair of shoes 48 and other miscellaneous bowling ball equipment such as towels, brushes, etc. as shown. This gives an added advantage over prior art bowling ball bags and equipment because the equipment is neatly stored and readily accessible.

Figure 3:
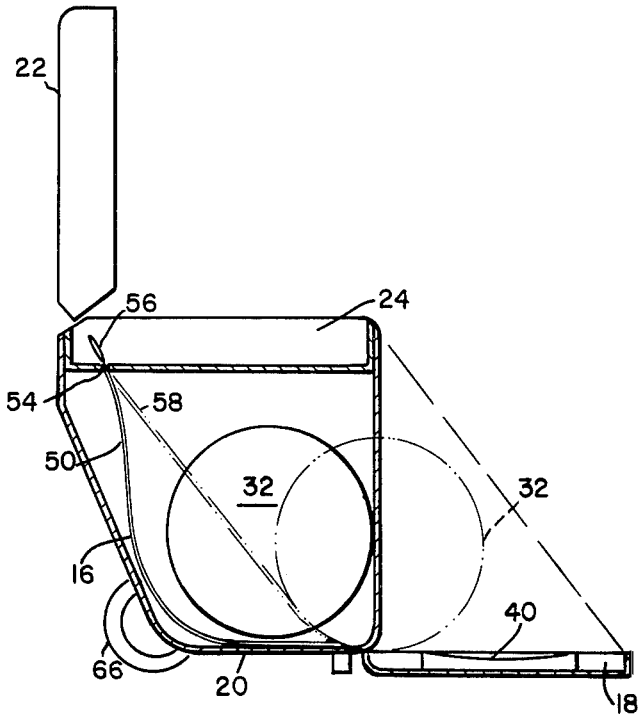
FIG. 3 is a side section view taken along the lines 3—3 of FIG. 1.
Figure 4:
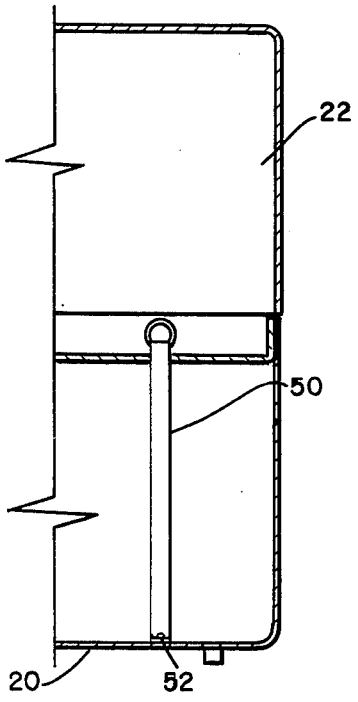
FIG. 4 is a partial section view taken along the lines 4—4 of FIG. 1 showing a partial side view of the bowling ball carrier of the present invention.
Figure 6:
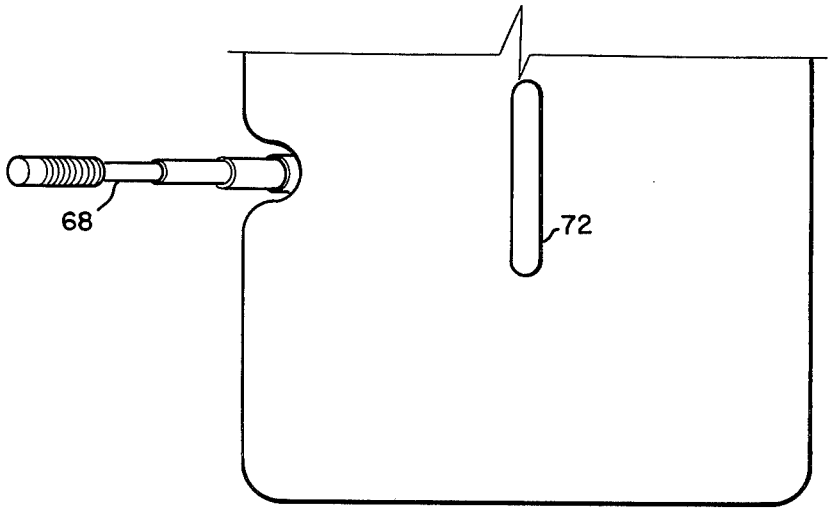
FIG. 6 is a top view taken along lines 6—6 of FIG. 5.

As shown in FIGS. 3 and 4, a strap 50 extends from the lower compartment and affixed to the bottom panel 20 in a suitable manner such as by rivits 52 as shown in FIG. 4. The strap 50 is designed to lay across the concave indentation 34 as shown in FIGS. 2 and 3 under the bowling ball 32 and through a suitable slot 54 and extends into the upper compartment 24. A ring 56 is attached to the end of the strap 50 so should the bowler want access to his bowling ball he simply reaches in the upper compartment, pulls the strap taunt as shown at 58 which causes the ball to roll forward down the groove 42 and into its resting place 40 as shown by the phantom lines in FIG. 1.

Should the front opening door 18 be closed by the spring, the weight of the ball 32 will automatically open the door causing the ball to roll into the resting place 40. A similar strap arrangement is provided for compartment 26, bowling ball 30 but is not shown for clarity. An axle in a pair of wheels 60 and 62 and an axle 64 is mounted to the panel 16 which is somewhat slanted so that the box may be rolled along the floor or the ground. A telescoping handle 68 is connected to the back panel 16 in a suitable manner and has a grip 70 thereon so that the handle can be snugly positioned out of sight when not in use and yet extended so that it may be pulled by the bowler. A top handle 72 is connected to the top opening door 22 so that if the users so desires he may carry it by the handle.

I claim:

1. A bowling ball carrier including:
at least one lower compartment for confining a bowling ball therein and having an open front;
at least one upper compartment for confining articles therein;
a downward swingable door mounted on the front of said lower compartment; and
means mounted to said carrier for moving said bowling ball from within said lower compartment onto said door, said door having a concave portion therein for said bowling ball to rest therein when moved from said compartment onto said door.

2. The bowling ball carrier as defined in claim 1 wherein said lower compartment having a bottom therein with a concave portion for said bowling ball to rest therein when confined in said compartment.

3. The bowling ball carrier as defined in claim 1 wherein:
said lower compartment having a bottom therein with a concave portion for said bowling ball to rest therein when confined in said compartment; and
said door having a concave portion therein for said bowling ball to rest therein when moved from said compartment onto said door.

4. The bowling ball carrier as defined in claim 1 wherein said means for moving said bowling ball from within said lower compartment onto said door including a strap mounted in said lower compartment and accessible from said upper compartment and surrounds a portion of said ball.

5. The bowling ball carrier as defined in claim 4 wherein said lower compartment having a bottom therein with a concave portion for said bowling ball to rest therein when confined in said compartment.

6. The bowling ball carrier as defined in claim 4 wherein said door having a concave portion therein for said bowling ball to rest therein when moved from said compartment onto said door.

7. The bowling ball carrier as defined in claim 4 wherein:
said lower compartment having a bottom therein with a concave portion for said bowling ball to rest therein when confined in said compartment; and
said door having a concave portion therein for said bowling ball to rest therein when moved from said compartment onto said door.

8. The bowling ball carrier as defined in claim 7 and further including:
a pair of wheels mounted to said carrier for said carrier to be rolled thereon; and
a telescoping handle mounted to said carrier for moving said carrier on said wheels.

9. The bowling ball carrier as defined in claim 1 and further including a door mounted to close said upper compartment.

10. A bowling ball carrier including:
at least one lower compartment for confining a bowling ball therein;
at least one upper compartment for confining articles therein;
a downward swingable door mounted on the front of said lower compartment; and
means mounted to said carrier for causing said bowling ball to roll forward from within said lower compartment onto said door.

11. The bowling ball carrier as defined in claim 10 wherein said lower compartment having a concave portion for said bowling ball to rest thereon when confined in said compartment, said door having a concave portion therein for said bowling ball to rest therein when moved from said compartment onto said door, said door further including a track therein leading from said concave portion on said door towards said concave portion in said lower compartment.

* * * * *